US008197265B1

(12) United States Patent
Lee et al.

(10) Patent No.: US 8,197,265 B1
(45) Date of Patent: Jun. 12, 2012

(54) GROUND-INTEGRATED ELECTRICAL ADAPTOR

(75) Inventors: Chiu-San Lee, New Taipei (TW); Su-Chen Shen, New Taipei (TW)

(73) Assignee: XYZ Science Co., Ltd., New Taipei (TW)

( * ) Notice: Subject to any disclaimer, the term of this patent is extended or adjusted under 35 U.S.C. 154(b) by 0 days.

(21) Appl. No.: 13/012,786

(22) Filed: Jan. 24, 2011

(51) Int. Cl.
*H01R 4/66* (2006.01)

(52) U.S. Cl. ..... 439/105; 439/108; 439/651; 439/655; 439/680

(58) Field of Classification Search ..... 439/105, 439/108, 650–655, 680, 374
See application file for complete search history.

(56) References Cited

U.S. PATENT DOCUMENTS 5,919,060 A * 7/1999 Lee ..... 439/518
5,941,724 A * 8/1999 Reed ..... 439/346
6,007,346 A * 12/1999 Gutierrez et al. ..... 439/35
6,247,941 B1 * 6/2001 Lee et al. ..... 439/105
6,328,581 B1 * 12/2001 Lee et al. ..... 439/106
6,330,144 B1 * 12/2001 Lee et al. ..... 361/115
6,428,339 B1 * 8/2002 Davidson et al. ..... 439/346
6,767,245 B2 * 7/2004 King ..... 439/535
7,052,298 B1 * 5/2006 Cheng ..... 439/171
7,354,286 B1 * 4/2008 Lee ..... 439/172
7,422,452 B2 * 9/2008 Achtner et al. ..... 439/106
7,771,214 B2 * 8/2010 Wang et al. ..... 439/106
7,967,609 B2 * 6/2011 Capece et al. ..... 439/39
2011/0045677 A1 * 2/2011 Devlin et al. ..... 439/21
2011/0059623 A1 * 3/2011 Capece et al. ..... 439/39

* cited by examiner

*Primary Examiner* — Amy Cohen Johnson
*Assistant Examiner* — Vladimir Imas
(74) *Attorney, Agent, or Firm* — Leong C. Lei

(57) ABSTRACT

The electrical adaptor contains a casing having a receiving indentation. Two corresponding positioning notches are provided, respectively, along two opposing lateral side walls of the receiving indentation. Inside the receiving indentation, there are two prong holes, each having an electrical contact inside. A first ground piece is tightly embedded into a front notch along a front wall of the receiving indentation. An additional second ground piece is provided along a back wall of the receiving indentation, opposing the first ground piece. When a German- or French-style plug is plugged, its two positioning ribs on the lateral sides are received by the positioning notches, respectively, and its ground pieces in the front and back are received by the ground notches. In the mean time, its prongs are received by the prong holes and contacted by the electrical contacts, respectively.

4 Claims, 6 Drawing Sheets

GROUND-INTEGRATED ELECTRICAL ADAPTOR

TECHNICAL FIELD OF THE INVENTION

The present invention is generally related to electrical adaptors, and more particularly to an electrical adaptor integrating two ground styles.

DESCRIPTION OF THE PRIOR ART

Even though there are so called German/French plugs, the two countries adopt two different sockets. The German socket has two round holes for receiving the Neutral and Live pins and, along two opposing lateral side walls, two corresponding positioning notches are configured, respectively. Additionally, two ground notches are provided along a front side wall and a back side wall, respectively, and a ground piece is embedded in each ground notch. Depending on the manufacturers, there are various kinds of ground pieces of different appearance and quality. On the other hand, the French socket has an additional ground pin adjacent to two round holes receiving the Neutral and Live pins for insertion into a ground hole of the German/French plug.

The German/French plug probably has the best design. However, the foregoing ground pieces of the German socket and the ground pin of the French socket still have room for improvement.

SUMMARY OF THE INVENTION

Therefore, a novel electrical adaptor is provided herein so as to obviate the foregoing shortcomings of the prior art.

The electrical adaptor contains a casing having a receiving indentation configured on a top side. Along two opposing lateral side walls of the receiving indentation, two corresponding positioning notches are provided, respectively. Inside the receiving indentation, there are two prong holes, each having an electrical contact inside. A first ground piece is tightly embedded into a front notch along a front wall of the receiving indentation. An additional second ground piece is provided along a back wall of the receiving indentation, opposing the first ground piece. When a German/French plug is plugged, its two positioning ribs on the lateral sides are received by the positioning notches, respectively, and its ground pieces in the front and back are received by the ground notches. In the mean time, its prongs are received by the prong holes and contacted by the electrical contacts, respectively. As such, the electrical adaptor of the present invention integrates the grounding styles of both the German and French sockets.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
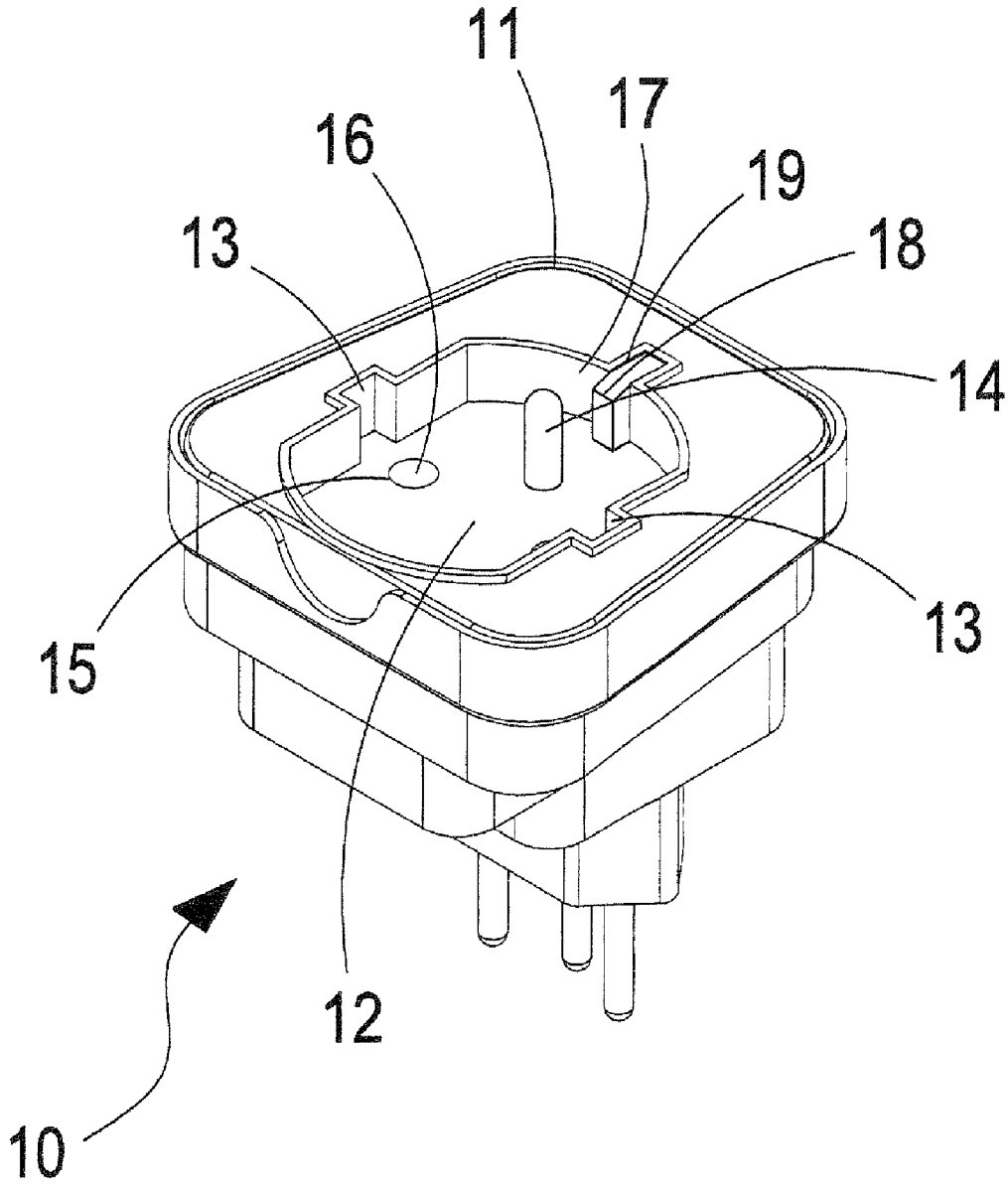
FIG. 1 is a perspective diagram showing an electrical adaptor according to a first embodiment of the present invention.

As shown in FIG. 1, an electrical adaptor 10 according to a first embodiment of the present invention contains a casing 11 having a receiving indentation 12 configured on a top side. Along two opposing lateral side walls of the receiving indentation 12, two corresponding positioning notches 13 are provided, respectively. Inside the receiving indentation 12, there are a ground pin 14 and two prong holes 15, each having an electrical contact 16 inside. A ground piece 18 is tightly embedded into a front notch 19 in front of the ground pin 14 along a front wall of the receiving indentation 12.

Figure 2:
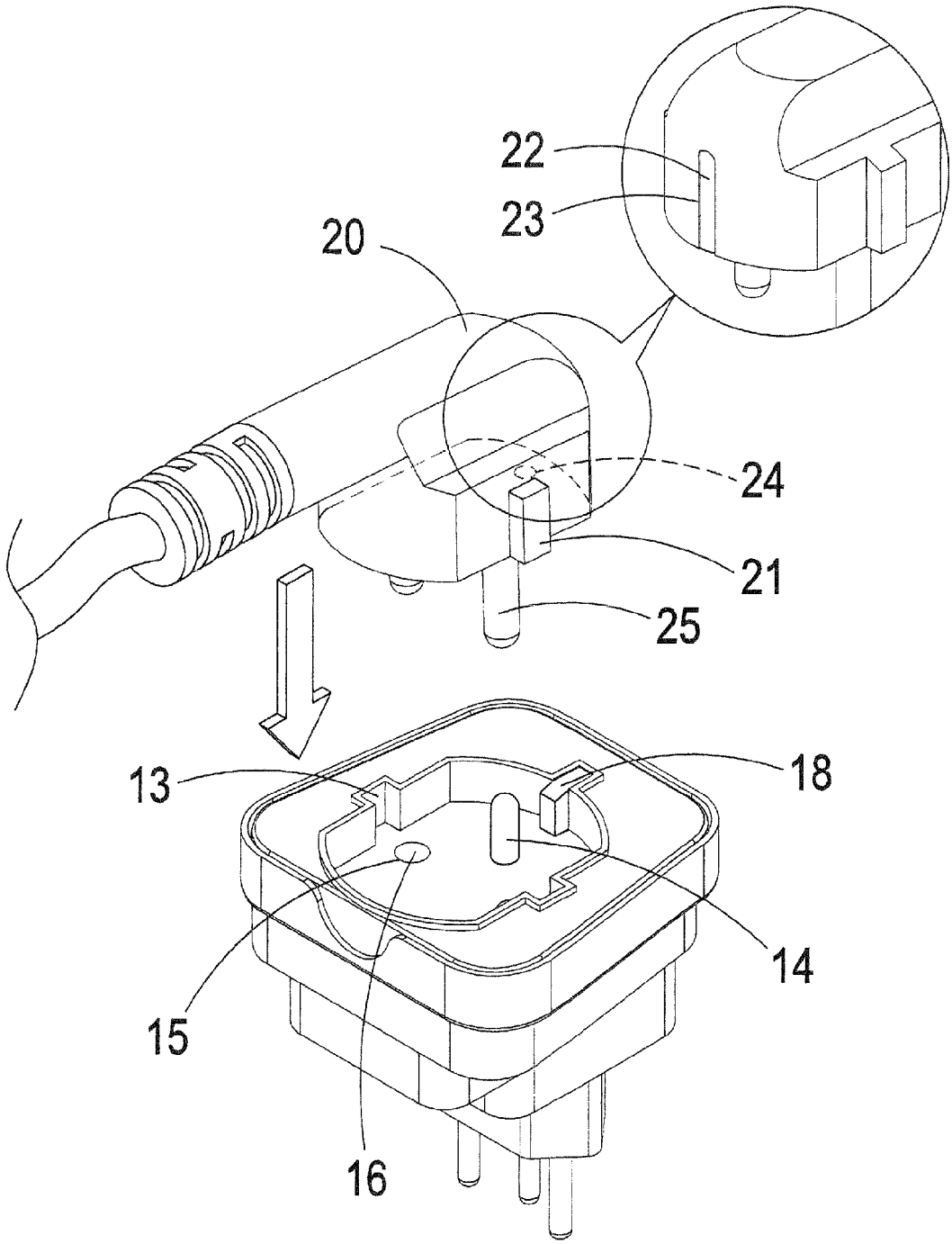
FIG. 2 is a perspective diagram showing the electrical adaptor of FIG. 1 receives a matching plug.

As also shown in FIG. 2, a plug 20 has two positioning ribs 21 on its lateral sides, respectively, and two prongs 25 (one for live and one for neutral connection) extended from a bottom side. Additionally, a ground notch 22 having a ground contact 23 inside is configured on a front side and a ground hole 24 on a bottom side behind the notch 22 and in front of the prongs 25. When the plug 20 is plugged into an electrical adaptor 10 of the present invention, the positioning ribs 21 are received by the positioning notches 13, and the ground piece 18 is received by the ground notch 24 and thereby contacted by the ground contact 23. In the mean time, the ground pin 14 is received by and conducted to the ground hole 24, and the prongs 25 are received by the prong holes 15 and contacted by the electrical contacts 16, respectively.

Figure 3:
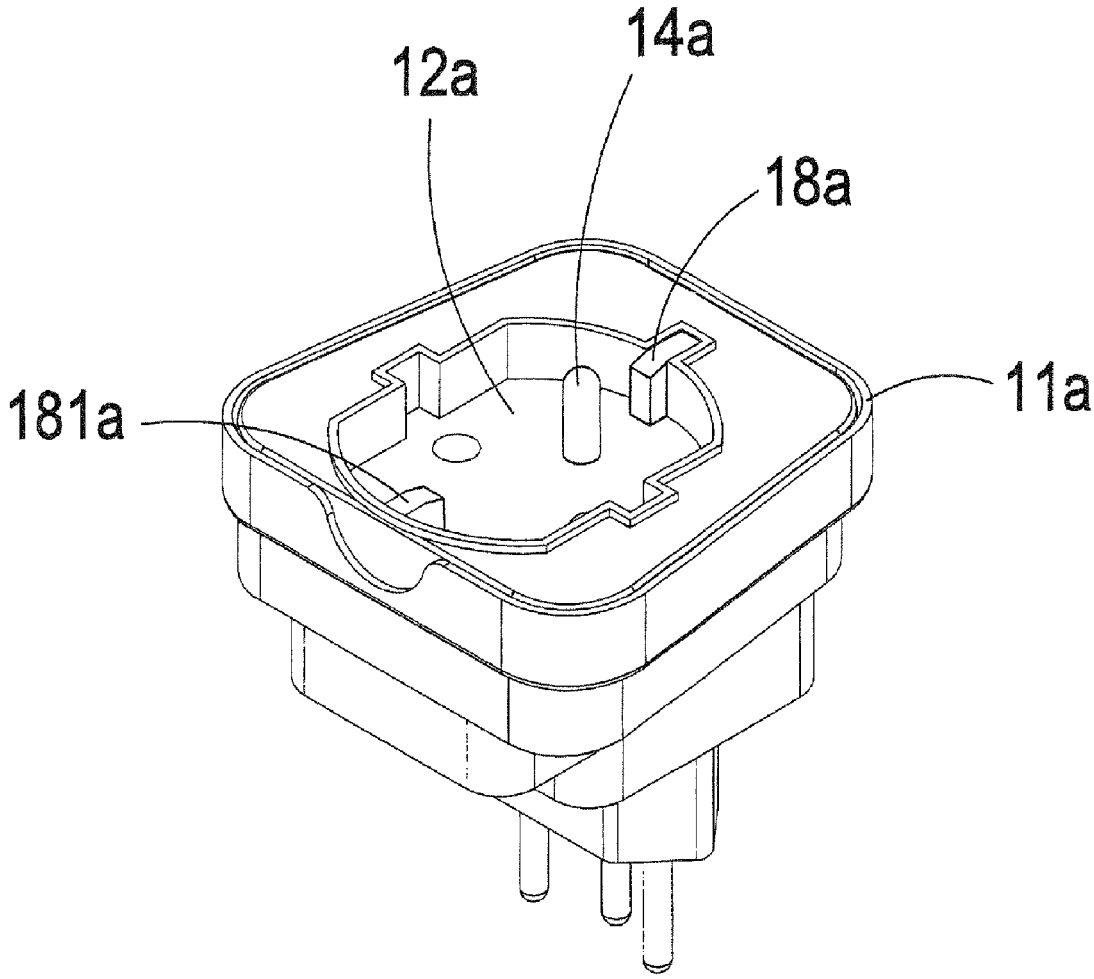
FIG. 3 is a perspective diagram showing an electrical adaptor according to a second embodiment of the present invention.

As shown in FIG. 3, an electrical adaptor according to a second embodiment of the present invention contains a casing 11*a* having a receiving indentation 12*a* configured on a top side. Along two opposing lateral side walls of the receiving indentation 12*a*, two corresponding positioning notches are provided, respectively. Inside the receiving indentation 12*a*, there are a ground pin 14*a* and two prong holes, each having an electrical contact inside. A first ground piece 18*a* is tightly embedded into a front notch in front of the ground pin 14*a* along a front wall of the receiving indentation 12*a*. Additionally, a second ground piece 181*a* is provided along a back wall of the receiving indentation 12*a*, opposing the first ground piece 18*a*.

Figure 4:
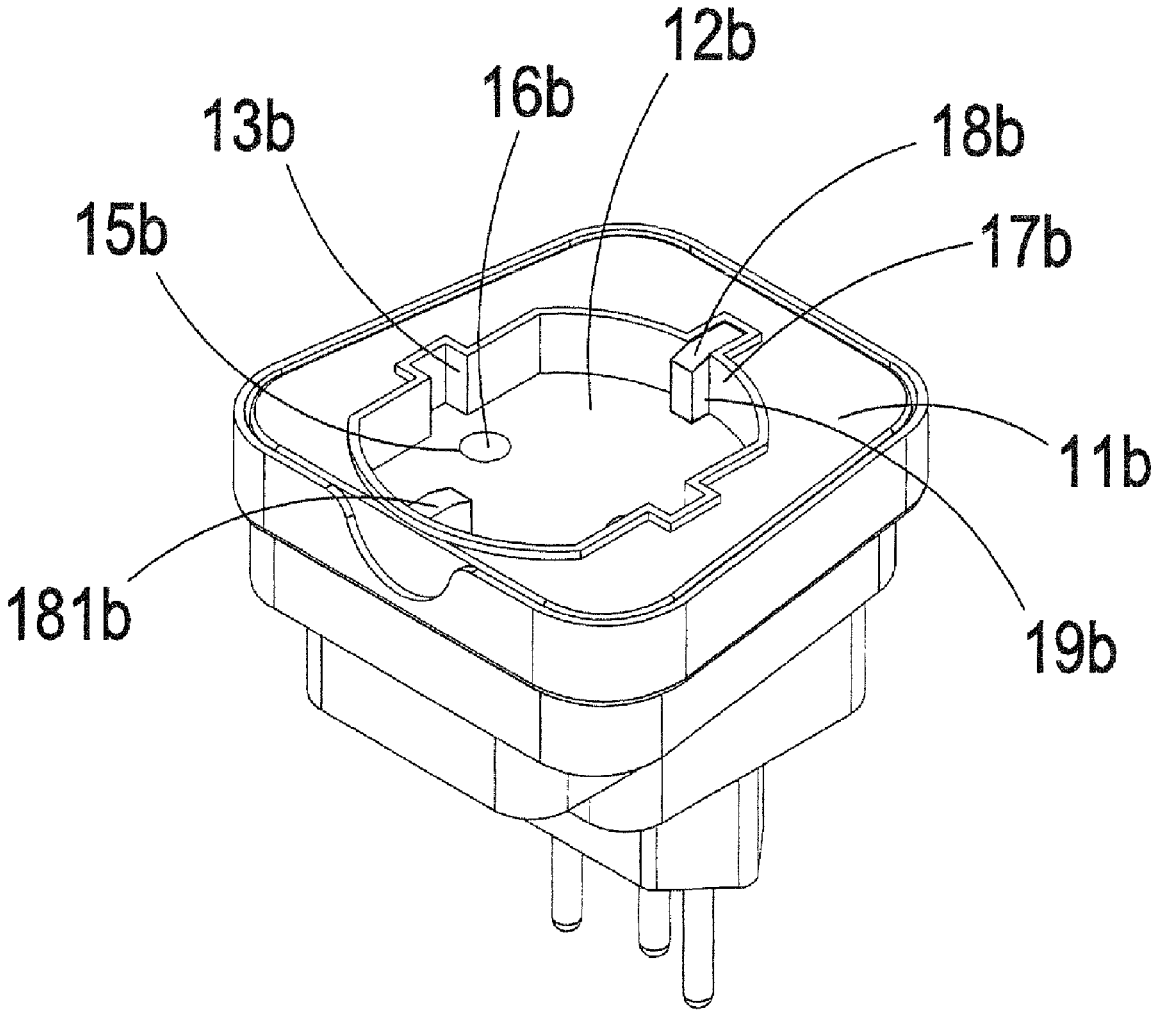
FIG. 4 is a perspective diagram showing an electrical adaptor according to a third embodiment of the present invention.

As shown in FIG. 4, an electrical adaptor according to a third embodiment of the present invention contains a casing 11*b* having a receiving indentation 12*b* configured on a top side. Along two opposing lateral side walls of the receiving indentation 12*b*, two corresponding positioning notches 13*b* are provided, respectively. Inside the receiving indentation 12*b*, there are two prong holes 15*b*, each having an electrical contact 16*b* inside. A first ground piece 18*b* is tightly embedded into a front notch 19*b* along a front wall 17*b* of the receiving indentation 12*b*. Additionally, a second ground piece 181*b* is provided along a back wall of the receiving indentation 12*b*, opposing the first ground piece 18*b*.

Figure 5:
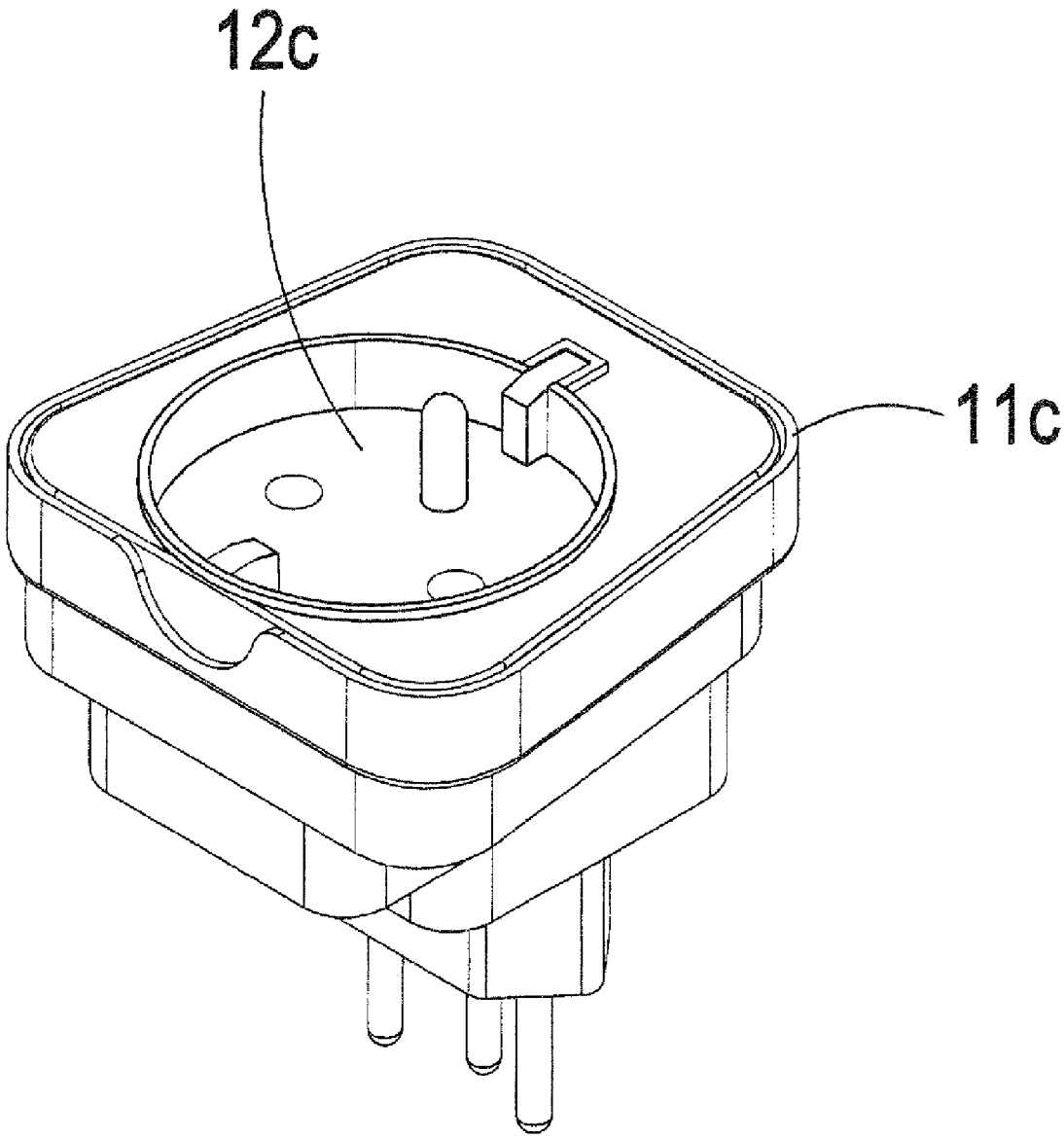
FIG. 5 is a perspective diagram showing an electrical adaptor according to a fourth embodiment of the present invention.
Figure 6:
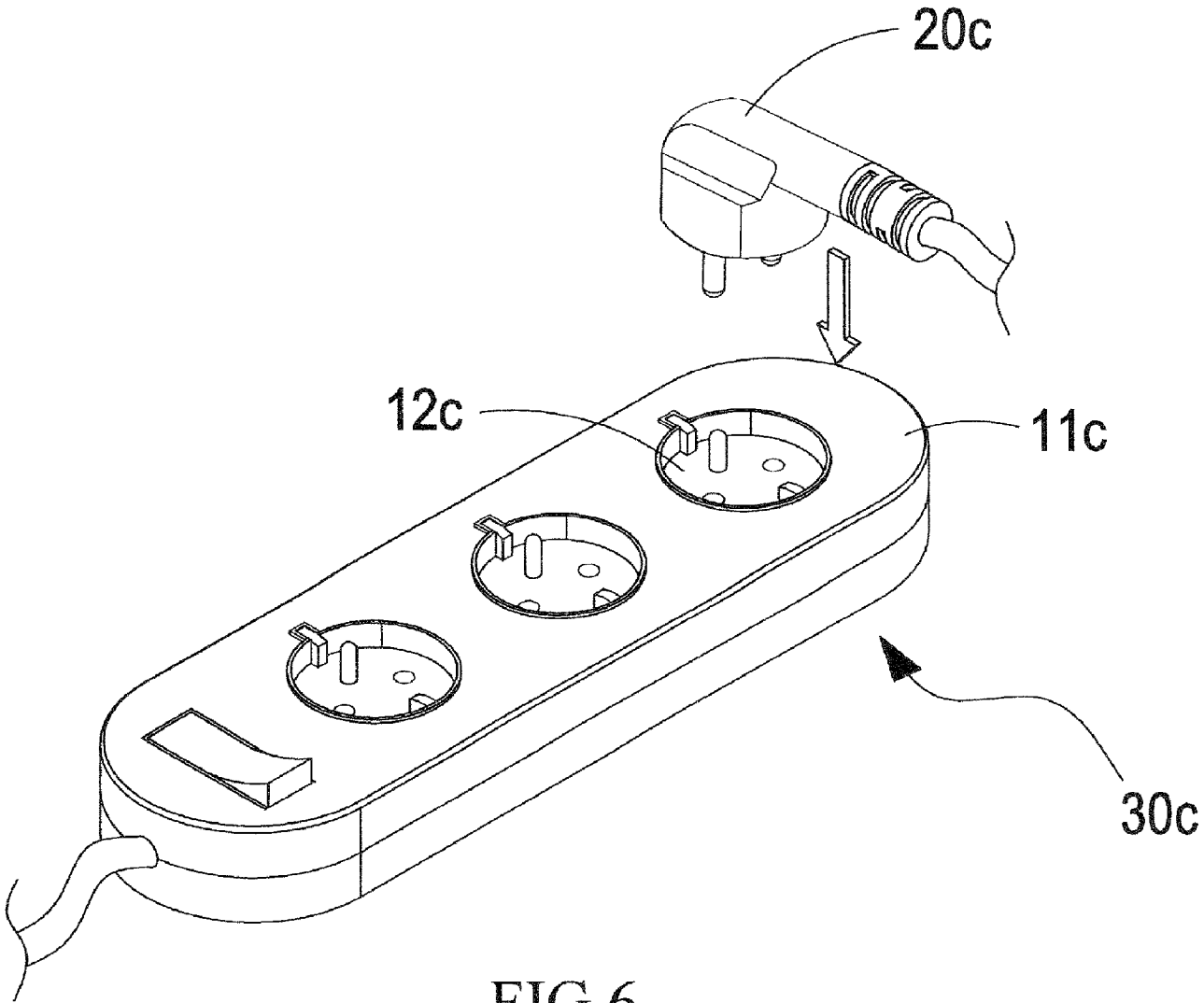
FIG. 6 is a perspective diagram showing a number of the electrical adaptors of FIG. 5 are combined into a multi-plug electrical adaptor.

As shown in FIG. 5, an electrical adaptor according to a fourth embodiment of the present invention contains a casing 11*c* having a receiving indentation 12*c* configured on a top side. The present embodiment is identical to the second embodiment, except that the receiving indentation 12*c* has a circular shape and does not have the positioning notches. The shape of the receiving indentation 12*c* actually could be changed as required. A number of the electrical adaptors of the present invention could be combined into a multi-plug electrical adaptor 30*c* as illustrated in FIG. 6, where three electrical adaptors of the fourth embodiment are deployed and each receives a matching plug 20*c*.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A ground-integrated electrical adaptor, comprising a casing having:

a receiving indentation on a top side of said casing;

two corresponding positioning notches along two opposing lateral side walls of said receiving indentation;

a ground pin inside said receiving indentation;

a front notch provided in front of said ground pin along a front wall of said receiving indentation;

two prong holes inside said receiving indentation, each having an electrical contact inside; and a first ground piece provided in front of said ground pin along a front wall of said receiving indentation and said first ground piece is tightly embedded in said front notch.

2. The ground-integrated electrical adaptor according to claim 1, wherein said casing further has a second ground piece is provided along a back wall of said receiving indentation, opposing said first ground piece.

3. The ground-integrated electrical adaptor according to claim 1, wherein said receiving indentation has a circular shape.

4. The ground-integrated electrical adaptor according to claim 1, further comprising at least an additional said casing to form a multi-plug adaptor.

* * * * *